US006179764B1

(12) United States Patent
Eckert

(10) Patent No.: US 6,179,764 B1
(45) Date of Patent: Jan. 30, 2001

(54) METHOD AND DEVICE FOR TREATING MOVING PAPER WEBS

(75) Inventor: Günther Oskar Eckert, Zellingen (DE)

(73) Assignee: Koenig & Bauer Aktiengesellschaft, Wurzburg (DE)

( * ) Notice: Under 35 U.S.C. 154(b), the term of this patent shall be extended for 0 days.

(21) Appl. No.: 09/319,945

(22) PCT Filed: Dec. 12, 1997

(86) PCT No.: PCT/DE97/02896

§ 371 Date: Sep. 22, 1999

§ 102(e) Date: Sep. 22, 1999

(87) PCT Pub. No.: WO98/28216

PCT Pub. Date: Jul. 2, 1998

(30) Foreign Application Priority Data

Dec. 21, 1996 (DE) ..... 196 53 804

(51) Int. Cl.[7] ..... B31F 7/00

(52) U.S. Cl. ..... 493/356; 493/359; 493/360; 493/370; 493/402; 493/405; 493/442; 493/444

(58) Field of Search ..... 493/356, 359, 493/360, 361, 365, 370, 388, 397, 402, 403, 405, 424, 425, 426, 427, 428, 435, 442, 444; 492/15, 26, 36; 83/956, 343, 345

(56) References Cited

U.S. PATENT DOCUMENTS

| | | | | |
|---|---|---|---|---|
| 3,908,808 | * | 9/1975 | Busker | 492/15 |
| 4,102,026 | * | 7/1978 | DeMasi | 492/15 |
| 4,680,843 | * | 7/1987 | Junk et al. | 492/26 |
| 4,917,665 | * | 4/1990 | Couturier | 493/365 |
| 5,259,604 | * | 11/1993 | Schneider et al. | 270/47 |
| 5,553,806 | * | 9/1996 | Lucas | 492/36 |
| 5,702,341 | * | 12/1997 | Keilhau | 493/426 |
| 5,752,437 | * | 5/1998 | Wilkens et al. | 492/36 |
| 6,038,974 | * | 3/2000 | Richards | 493/359 |

FOREIGN PATENT DOCUMENTS 226943 6/1909 (DE) .

* cited by examiner

*Primary Examiner*—Stephen F. Gerrity
*Assistant Examiner*—Sam Tawfik
(74) *Attorney, Agent, or Firm*—Jones, Tullar & Cooper, PC

(57) ABSTRACT

Moving paper webs are treated by having a cross-groove or crease pressed into them prior to being transversely cut and folded. The cross-groove or crease is produced by a radially vibrating, rail-like pressure tool that cooperates with a counter-pressure tool. These tools cooperate to form a sharp, folded crease, even in thick products. The crease is formed along the to be formed cross fold line.

10 Claims, 2 Drawing Sheets

METHOD AND DEVICE FOR TREATING MOVING PAPER WEBS

FIELD OF THE INVENTION

The present invention relates to a method for processing moving paper webs, as well as to the associated device.

DESCRIPTION OF THE PRIOR ART

It is known from DE-PS 226 943 to transversely cut a paper web strand into signatures by means of a pair of cylinders and to subsequently cross-groove it.

It is a limitation of this prior art device that it is not possible to produce an overfold or a bottom fold in the course of this. Moreover, cross-grooving of signatures is only possible up to a defined thickness.

SUMMARY OF THE INVENTION

The object of the present invention is based on providing a method, as well as an associated device, for preparing a sharp-edged fold, in particular for thick signatures.

This object is attained in accordance with the invention by the provision of a pressing device which includes a rotating first support for a pressing tool, and a rotating second support for a counter-pressing tool. This pressing device is located upstream, in the direction of travel of a moving paper web, of a web cutting and transverse folding device. This pressing or creasing device creates transverse fold lines in the web before the web is cut.

The advantages which can be achieved by means of the invention rest, in particular, in that it is possible, by means of a vibration-supported pre-processing of paper webs, to transversely fold even thick signatures with good quality. It is furthermore advantageous, if individual or divided paper web strands are respectively separately pre-processed, and thereafter are conducted to a collection cylinder. Sharp-edged folds of high quality can also be produced during transverse folding of thick signatures by means of the method and the device of the present invention.

BRIEF DESCRIPTION OF THE DRAWINGS

A preferred embodiment of the present invention is represented in the drawings and will be described in greater detail in what follows.

Shown are in.

DETAILED DESCRIPTION OF THE PREFERRED EMBODIMENTS

Figure 1:
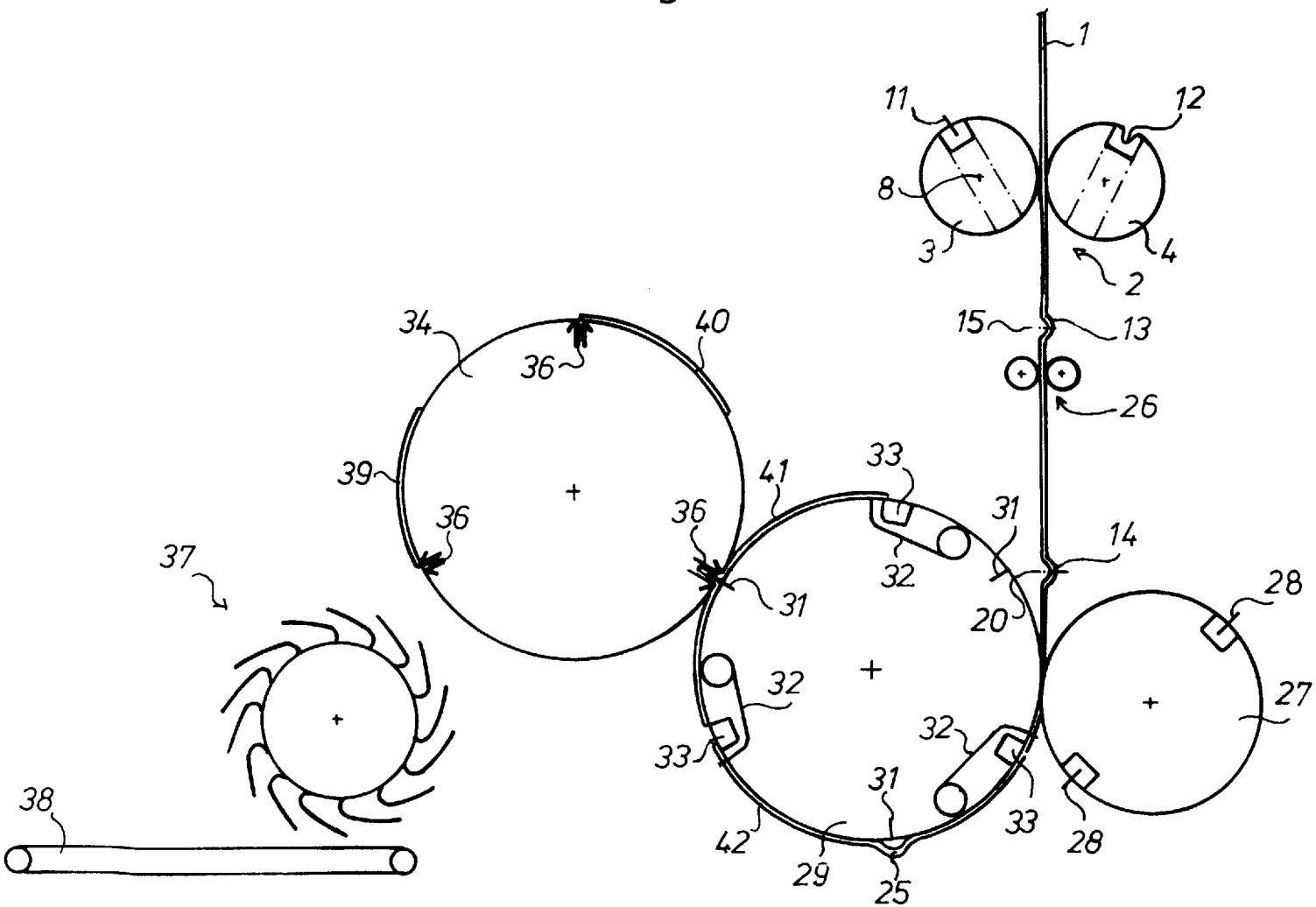
FIG. 1, a schematic representation of a lateral view of a folding apparatus without lateral frames but with a device for processing a moving paper web, and in FIG. 2, an enlarged schematic representation of a pressing tool, which can vibrate, arranged on a support.

The device of the present invention for processing a moving paper web 1, or respectively paper webs, or a paper web strand, consists of a pressing or creasing device 2. The pressing device 2 has two supports 3, 4, which rotate along with the paper web 1. The first and second supports 3, 4 can also each have a rectangular cross section, as shown in dashed lines, or also can have the represented circular cross section as seen in FIG. 1.

Figure 2:
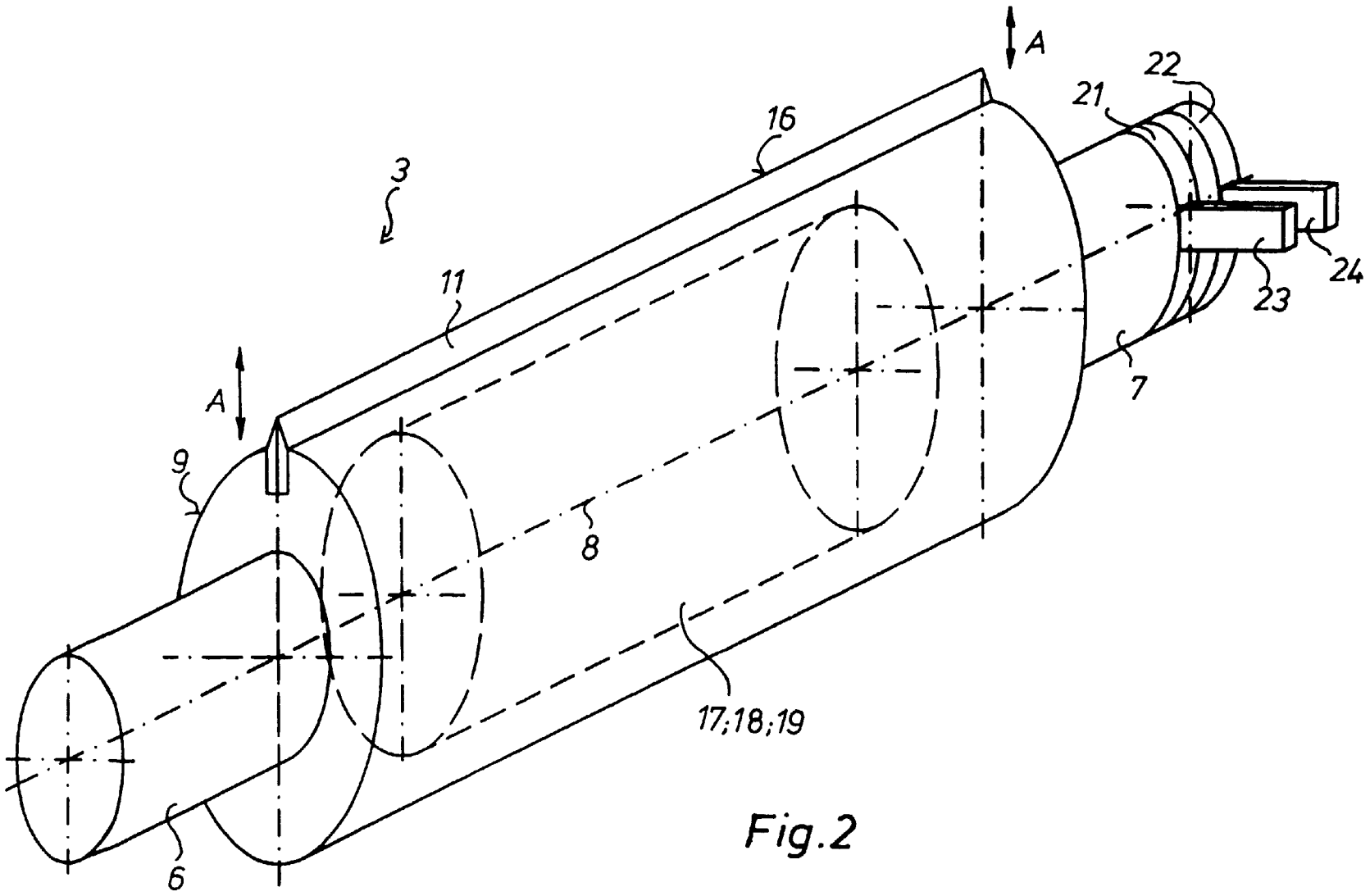

On each of its two ends, the first support 3 has journals 6, 7, as seen in FIG. 2, and, in a direction parallel with its axis of rotation 8, has a rail-like pressing tool 11, which projects out of the circumference 9 of first support 3, is connected with the first support 3 and has a working edge 16 on its side facing away from the support 3. The pressing tool 11 operates, together with a counter-pressing tool 12 which may be, for example a resilient strip made of rubber or plastic, and which is located on the circumference of the second support 4 and extends in an axis-parallel direction, as depicted in FIG. 1.

The pressing tool 11 is rounded on its working edge 16, by means of which cutting of the paper web strand 1 is prevented. The rail-like pressing tool 11 can be made of one piece in the axial direction of the first support 3, or it can be divided into several parts. During operation, the working edge 16 of the pressing tool 11 dips into the counter-pressing tool 12 and exerts pressure on the paper web strand 1 located between them.

In accordance with a preferred embodiment of the present invention, the pressing tool 11 acts as a sonotrode and constitutes the last link in a chain, which consists of a vibration generator, for example including an ultrasound generator 17, a converter 18 and an amplifier 19, as depicted in FIG. 2. The ultrasound from the ultrasound generator of the vibration generator in the range between 20 or 40 kilohertz, aids in the pre-breaking of the paper fibers at a predetermined transverse fold line 15, 20 of the paper web strand 1.

A journal 7 of the first support can have collector rings 21, 22, by means of which collector ring bodies 23, 24 assure the energy supply for the ultrasound tool.

The pressing tool 11 can also be connected with a magnetic vibration generator arranged in the first support 3.

The pressing tool 11 vibrates back and forth in the radial direction A, so that several strokes of the pressing tool 11, per pressing operation, are exerted on the signatures 39 to 42. In the course of this pressing operation, the fibers of the paper web strand 1, which in particular are oriented in the paper web strand movement direction, are either plastically deformed or are pre-broken, depending on a preset amount of the exerted pressure.

The paper web strand 1, which has been provided with cross grooves 13, 14, 25 in this way, is, supported by a pair of drawing rollers 26, and is conducted to an inlet gap between a two-part cutting cylinder 27 with two cutters 28 for transverse cutting, and a three-part puncture- and folding blade cylinder 29. The puncture- and folding blade cylinder 29, which may be a collection cylinder, has, on its circumference, folding blade systems 31 and puncture systems 32 arranged at equal distances, as well as counter-cutting strips 33 arranged next to the puncture systems 32. A three-part folding jaw cylinder 34 with folding jaws 36 for transverse folding of the signatures along the transverse fold lines 14, 15, or respectively along the prepared cross grooves 13, 14, 25 formed at the transverse fold lines 14, 15, is connected with the puncture- and folding blade cylinder 29, which then deposits the folded printed products, by means of a paddle wheel 37, on a belt delivery device 38.

It is also possible, in a configuration differing from the representation in FIG. 1, to conduct two or several separate paper strands which, however, had previously been cross-grooved by respectively separate pressing devices 2, and which only come together in front of the pair of drawing rollers 26, to the folding apparatus. This arrangement is advantageous, particularly with very thick signatures. In the course of cross-grooving, a maximum bending radius of the cross grooves is respectively obtained, which approximately corresponds to the thickness of the paper strand 1. By means of this, the outer layer, for example that of collected products, is also sharply edged.

It is of course also possible to divide a thick paper web strand 1, for example, into several individual paper web strands prior to processing, and to conduct each of the paper web strands to separate pressing devices 2, after which the several individual paper web strands are subsequently reunited, transversely cut or transversely folded.

It is furthermore possible to utilize different cylinder divisions for the pressing device 2. Thus, the first support 3 and the second support 4 can also respectively be designed to have two fields, or also can have another division.

Finally, because of the separation of the cutting and cross-grooving processes, it is also possible to produce an overfold or a bottom fold in connection with the transversely folded signatures.

In accordance with another preferred embodiment, it is possible to design the counter-pressing tool 12 housed in the second support 4 as a groove, which is cut in the second support 4 in the axis-parallel direction and has a groove bottom made of a resilient material, for example of plastic or rubber.

Finally, a strip used as a counter-pressing tool 12 can also be connected with a vibration generator 17, not represented, arranged in the second support 4, by means of which the cross grooves can be made particularly effectively.

While preferred embodiments of a device for treating paper webs in accordance with the present invention have been set forth fully and completely hereinabove, it will be apparent to one of skill in the art that a number of changes in, for example, the type of printing press used with the device, the drive assembly for the various cylinders, and the like can be made without departing from the true spirit and scope of the present invention which is accordingly to be limited only by the following claims.

What is claimed is:

1. A method for processing moving paper webs comprising:

providing a pressing device having supports for a rail-like pressing tool and for a cooperating counter-pressing tool;

positioning said pressing device transverse to a direction of travel of a moving paper web;

providing a vibration generator in at least one of said supports for said pressing tool and for said cooperating counter-pressing tool;

operating said vibration generator;

causing at least one of said pressing tool and said counter-pressing tool to vibrate in a direction toward and away from a surface of said moving paper web in response to said operation of said vibration generation;

passing said paper web between said pressing tool and said counter-pressing tool;

exerting a pressure on said moving paper web in said pressing device along an intended transverse fold line by means of said vibrating pressing device;

forming creases in said moving paper web in said pressing device by using said vibrating pressing device;

subsequently transversely cutting said moving paper web into signatures; and folding said signatures transversely along said intended transverse fold line.

2. The method of claim 1 further including dividing said moving paper web into several moving paper web stands, providing a separate said pressing device for each of said several moving paper web strands, processing each of said several moving paper web strands, in an associated one of said separate pressing devices, and combining said several moving paper web strands after passage through said separate pressing devices.

3. A device for processing moving paper webs comprising:

a pressing device, said pressing device including a rotating first support and a rotating second support;

a pressing tool supported on said rotating first support;

a counter-pressing tool supported on said rotating second support, said pressing tool and said counter-pressing tool cooperating to crease a moving paper web passing between them;

means for vibrating at least one of said pressing tool and said counter-pressing tool transversely to a direction of travel of a moving paper web passing between said pressing tool and said counter-pressing tool; and a cutting and transverse paper web folding device, said pressing device being arranged upstream, in said direction of travel of a moving paper web, of said cutting and transverse paper web folding device.

4. The device of claim 3 wherein said pressing tool is rail-like and has a working edge and further wherein said rotating first support has a first axis of rotation, said pressing tool being supported on said rotating first support parallel to said first axis of rotation.

5. The device of claim 3 wherein said means for vibrating said at least one of said pressing tool and said counter-pressing tool includes a vibration generator in said rotating first support, said pressing tool being connected to said vibration generator.

6. The device of claim 5 wherein said vibration generator is a magnetic vibration generator.

7. The device of claim 3 wherein said counter-pressing tool includes a resilient strip and further wherein said rotating second support has a second axis of rotation, said counter-pressing tool being supported on said rotating second support parallel to said second axis of rotation.

8. The device of claim 7 wherein said means for vibrating said at least one of said pressing tool and said counter-Pressing tool includes a vibration generator in said rotating second support, said counter-pressing tool being connected with said vibration generator.

9. The device of claim 8 wherein said vibration generator is a magnetic vibration generator.

10. The device of claim 3 wherein said counter-pressing tool includes a groove with a resilient groove bottom, said counter-pressing tool being supported on said rotating second support, said rotating second support having a second axis of rotation, said counter-pressing tool extending parallel to said second axis of rotation.

* * * * *